United States Patent [19]

Roestenberg

[11] Patent Number: 4,622,782

[45] Date of Patent: Nov. 18, 1986

[54] SANDER SHIELD

[76] Inventor: Jerome R. Roestenberg, 11 Woodpecker La., Levittown, N.Y. 11756

[21] Appl. No.: 764,041

[22] Filed: Aug. 9, 1985

[51] Int. Cl.[4] ..... B24B 55/06

[52] U.S. Cl. ..... 51/273; 51/170 T

[58] Field of Search ..... 51/273, 170 T, 170 R

[56] References Cited

U.S. PATENT DOCUMENTS

| | | | |
|---|---|---|---|
| 3,673,744 | 7/1972 | Oimoen | 51/170 T |
| 3,785,092 | 1/1974 | Hutchins | 51/273 |
| 3,824,745 | 7/1974 | Hutchins | 51/170 T |
| 3,935,678 | 2/1976 | Marton | 51/273 |

FOREIGN PATENT DOCUMENTS

| | | | |
|---|---|---|---|
| 2539762 | 3/1977 | Fed. Rep. of Germany | 51/273 |
| 211467 | 12/1982 | Japan | 51/170 T |
| 715760 | 9/1954 | United Kingdom | 51/273 |

*Primary Examiner*—Roscoe V. Parker

*Attorney, Agent, or Firm*—Nolte, Nolte and Hunter

[57] ABSTRACT

A vacuum shield for a rotary sander which can be easily attached to the sander and, in use, allows the surface being sanded to be easily viewed and also allows the sander to reach every part of the surface while the dust generated by the sander is continuously removed by vacuum hoses connected to the shield. The shieled includes a planar transparent top wall mounted on the sander and overlying the abrasive wheel of the sander. The top wall has: (1) a rear segment with a central hole, through which the abrasive wheel can be supported and driven by the sander motor, and a plurality of vacuum holes which are connected to the vacuum hoses; and (2) a front segment that can be pivoted upwardly about the front of the rear segment. The top wall also has a flexible skirt that depends from its peripheral edge and horizontally surrounds the abrasive wheel, even when the front segment is pivoted upwardly.

9 Claims, 3 Drawing Figures

SANDER SHIELD

BACKGROUND OF THE INVENTION

This invention relates to a vacuum attachment for an abrading machine such as a portable rotary sander. This invention particularly relates to a vacuum shield for enclosing, and removing dust generated by, the abrasive wheel of a rotary sander while not interfering with the use of the sander.

Vacuum hoods or shields for tools, such as abrading machines, are well known. See, for example, U.S. Pat. Nos. 3,673,744, 3,785,092, 3,824,745, 3,837,383, 3,935,678, 4,071,981, 4,135,334, 4,145,848, and 4,328,645. Typically, the interiors of such shields have been connected to one or more vacuum hoses which draw off dust generated within the shields by the abrading machines.

However, such shields have hindered the vision of the users of the abrading machines enclosed by such shields and have also prevented the abrading parts of such machines from reaching surfaces adjacent to intersecting walls or surfaces (e.g., in corners) which are to be abraded. This has made it difficult to use these shielded machines for abrading shaped and other non-flat surfaces to a highly smooth and uniform finish such as is required in the restoration and repair of, fo example, the sheet metal panels of automobile bodies. One solution of this problem has been to remove a portion of a shield's peripheral coverage of the abrading part of the abrading machine, but this has inevitably caused dust to escape from the resulting open portions of the shield. See, for example, U.S. Pat. Nos. 3,673,744 and 3,824,745.

There has been a need, therefore, for a vacuum shield for an abrading machine which allows the user of the abrading machine to view the surface being abraded and allows the abrading part of the machine, such as the abrasive wheel of a rotary sander, to reach every part of the surface without allowing dust to escape from the shield.

SUMMARY OF THE INVENTION

In accordance with this invention, a vacuum shield is provided for an abrading part of an abrading machine, comprising:

a generally planar top wall mounted on the abrading machine and overlying the abrading part of the abrading machine; the top wall of the shield being made of a rigid transparent material and comprising at least a first segment and a second segment; the first segment having a first hole therein, through which the abrading part can be supported and driven by the abrading machine; the first segment also having a plurality of second holes therein, each second hole being connected to a vacuum hose on top of the top wall and providing pneumatic communication through the top wall between the hose and the abrading part; and the second segment being pivotally connected to the first segment for upward pivotal movement of the second segment about its connection to the first segment; and a flexible skirt depending from the peripheral edge of the top wall and extending substantially continuously along the entire length of the peripheral edge of the top wall; the skirt substantially surrounding horizontally the abrading part of the abrading machine, even when the second segment is pivoted upwardly relative to the first segment.

The shield of this invention can be easily attached to the abrading machine and, in use, allows the surface being abraded to be easily viewed. The shield also allows the abrading part of the machine to reach every part of the surface, being abraded, while the dust generated by the abrading machine is continuously removed by the vacuum hoses connected to the shield.

DETAILED DESCRIPTION OF THE PREFERRED EMBODIMENT

Figure 1:
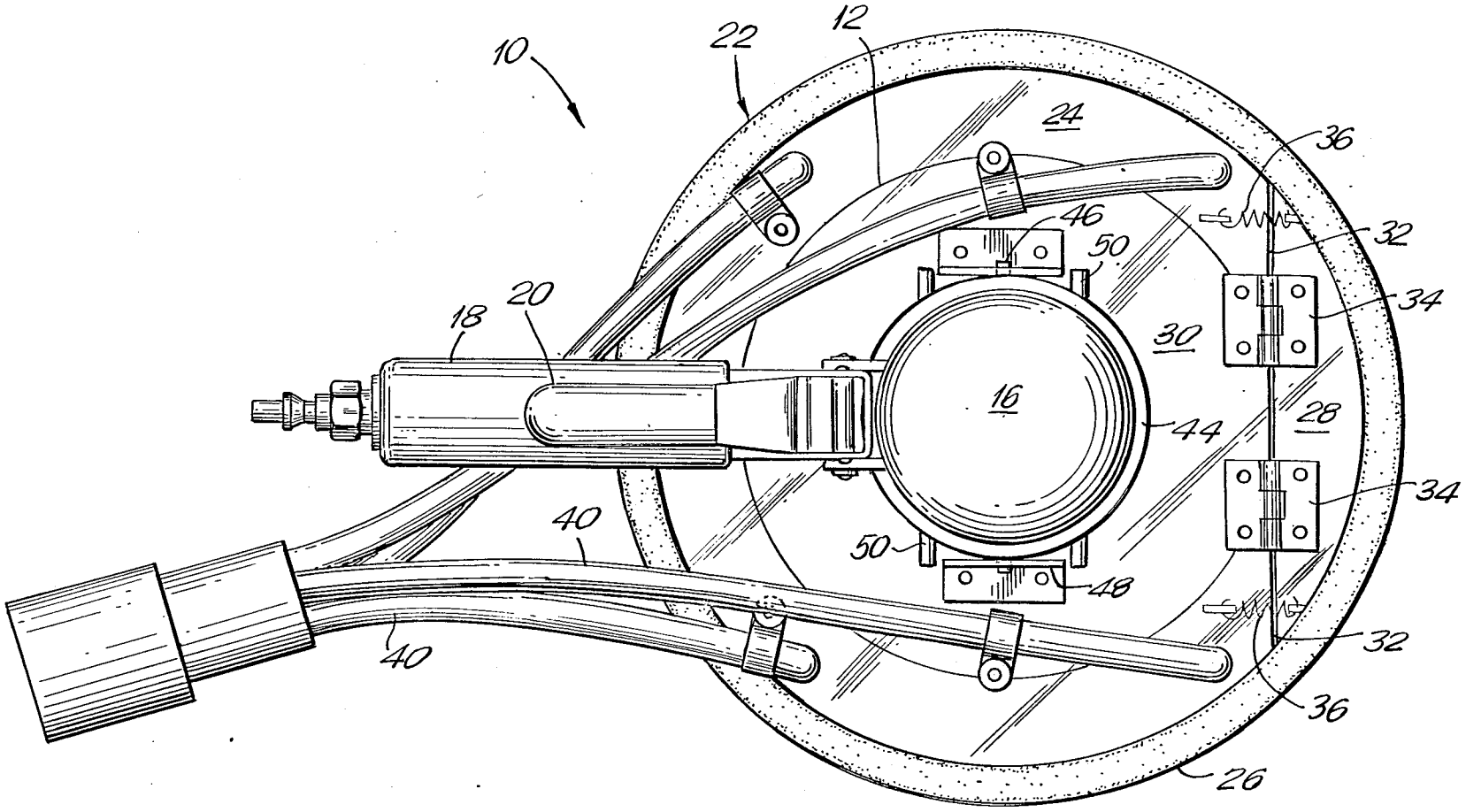
FIG. 1 is a top plan schematic view of an abrading machine on which is provided a vacuum shield of this invention.
Figure 2:
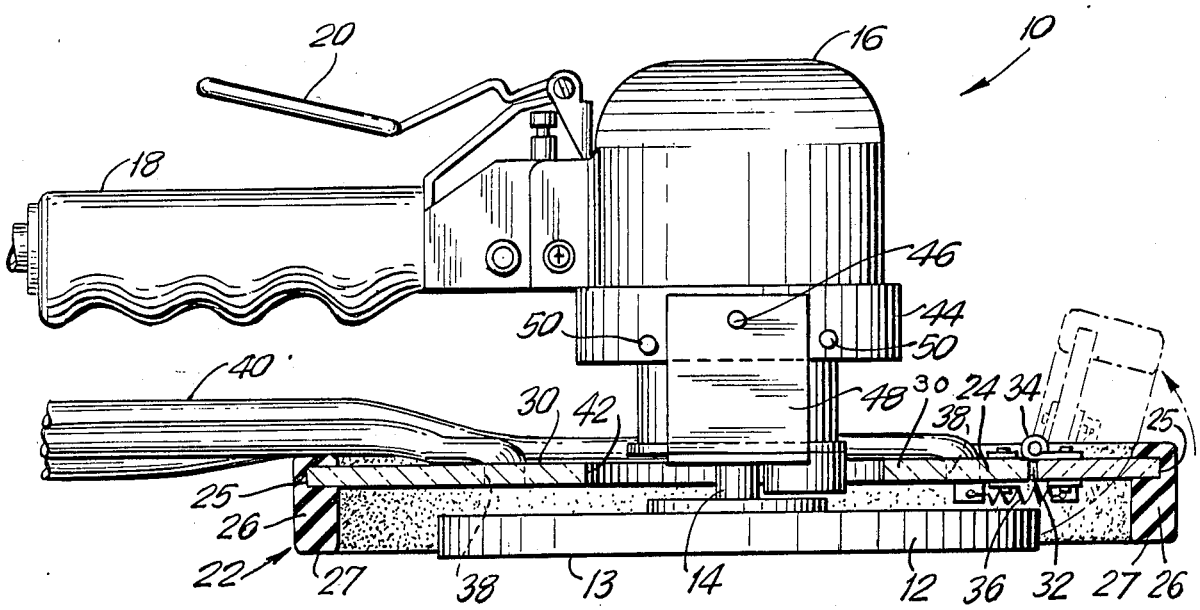
FIG. 2 is a side elevation view of the shield and abrading machine of FIG. 1. The shield is shown in section, taken along the vertical centerline of the shield.
Figure 3:
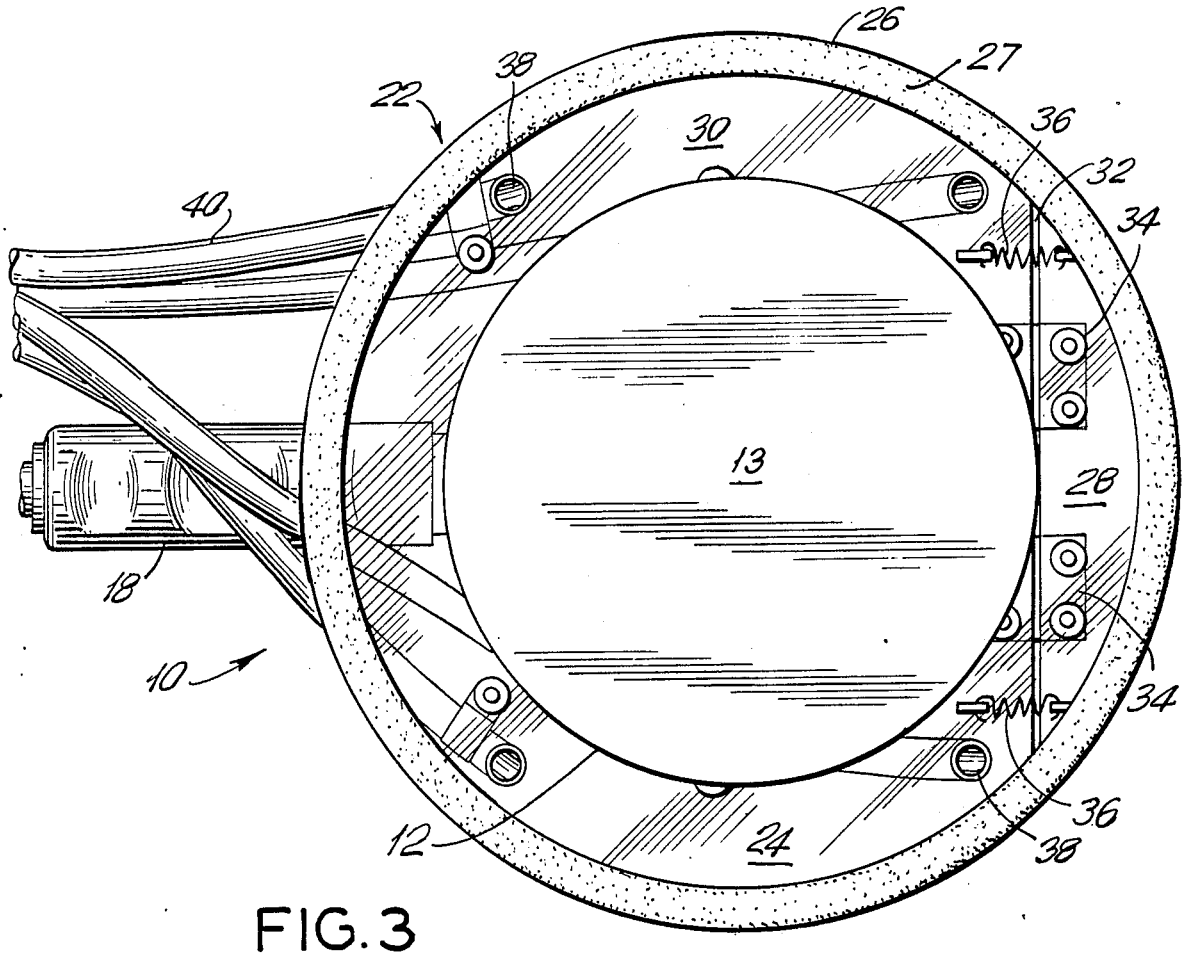
FIG. 3 is a bottom plan view of the abrading machine and shield of FIGS. 1 and 2.

Shown schematically in FIGS. 1–3 is a conventional portable, pneumatically powered, rotary sander, generally 10. On the bottom of the sander 10 is a conventional, generally round, rotatable abrasive wheel 12. A conventional abrasive (e.g., a sandpaper disc) can be removably (e.g., adhesively) attached to the flat bottom surface 13 of the wheel 12 so that the abrasive will rotate horizontally with the wheel 12 to abrade a surface against which the bottom surface 13 of the wheel 12 is urged. The top of the wheel 12 is detachably mounted on the bottom of a rotatable vertical shaft 14 (e.g., by means of a conventional central threaded aperture in the shaft 14 for receiving a vertical retaining screw on top of the wheel 12). The shaft 14 is connected to a conventional air driven rotary motor (not shown) in a housing 16 above the wheel 12. The motor is connected to a conventional source of compressed air (not shown) through a handle 18 on the housing 16. The motor is activated by a conventional trigger 20 connected to the housing 16 above the handle 18.

Also shown schematically in FIGS. 1–3 is a vacuum shield of this invention, generally 22, which is mounted on the sander 10 so that the shield covers the top and sides of the abrasive wheel 12. The shield 22 has a generally planar top wall 24 overlying the wheel 12. The top wall 24 has the generally round configuration of the wheel 12 but a somewhat larger diameter than the wheel 12 so that the peripheral edge 25 of the top wall 24 lies wholly outside the circumference of the wheel 12. The shield 22 also has a generally cylindrical, flexible skirt 26 that depends from the peripheral edge 25 of the top wall 24 and extends substantially continuously along the entire length of the peripheral edge 25 of the top wall 24. The skirt 26 serves as a substantially continuous barrier about the peripheral edge 25 of the top wall 24 to the escape of dust from the shield 22 during use of the sander 10. In this regard, the location of the bottom 27 of the skirt 26, relative to the bottom surface 13 of the wheel 12, is not critical, but it is preferred that the skirt bottom 27 be substantially parallel to the bottom surface 13 of the wheel 12. It is also preferred that the skirt bottom 27 not be spaced substantially above the bottom surface 13 of the wheel 12 so that, in use of the shield 22, the skirt bottom 27 rests on the surface being abraded by the abrasive bottom surface 13 of the wheel 12 of the sander 10.

The top wall 24 of the shield 22 is preferably made from a rigid transparent material, for example, a clear plastic such as a methacrylate polymer, a polystyrene or an ABS copolymer. The skirt 26 is preferably made of a flexible material which will allow substantially the entire length of the bottom 27 of the skirt to be pressed against, and conform to, the surface being abraded with the sander 10 without scratching the surface being abraded or allowing substantial amounts of dust to escape from the interior of the shield 22 through gaps between the surface being abraded and the skirt bottom 27. For example, the skirt 26 can be made from a bristle brush or an elastomeric member, such as a soft rubber blade or a thin rubber tubing, which extends lengthwise substantially continuously along the peripheral edge 25 of the top wall 24.

In accordance with this invention, the top wall 24 of the shield 22 comprises at least two separate segments 28 and 30, one segment 28 preferably forming the front portions of the top wall 24 and the other segment 30 forming the remaining rear portions of the top wall 24. In this regard, it is preferred that the front and rear segments 28 and 30 be pivotally connected to each along a line 32 that is substantially parallel to the front of the shield 22 between the front of the rear segment 30 and the rear of the front segment 28. As shown in FIGS. 1–3, the segments 28 and 30 of the top wall 24 are connected by means of two hinges 34 about the line 32 between the segments. As shown in FIG. 2, the front segment 28 can be pivoted upwardly about the front of the rear segment 30 to allow the bottom surface 13 of the abrasive wheel 12 to reach a surface which would not have been accessible without the front segment 28 pivoting upwardly, out of the way. For example, the front segment 28 can be pivoted upwardly when the bottom 27 of its shirt 26 has been urged atop an elevated portion of a surface being abraded or when the front of the front segment 28 has been urged against a surface perpendicular to a surface being abraded. However, when the front segment 28 is pivoted upwardly in this way, it is preferred that the skirt 26 continue to serve as a substantially continuous barrier about the periphery of the top wall 24, substantially surrounding horizontally the abrasive wheel 12 to prevent the escape of dust generated within the shield. For this reason, it is preferred that the shirt 26 be made of a continuous elastomeric material to assure that little or no dust can escape from the shield 22, through gaps formed between the front and rear segments 28 and 30, when the front segment 28 pivots upwardly about the rear segment 30. Preferably, the hinges 34 are also provided with conventional stops which limit the upward pivoting movement of the front segment 28 about the front of the rear segment 30.

As shown in FIGS 2 and 3, a pair of springs 36 are preferably connected to the front and rear segments 28 and 30 of the top wall 24 adjacent the hinges 34. The springs 36 urge the front segment 28 to pivot downwardly about the front of the rear segment 30 when the front segment 28 has pivoted upwardly (e.g., by being urged against a perpendicular surface in front of the shield 22).

As best shown in FIG. 3, a plurality of vacuum holes 38 are provided in the rear segment 30 of the top wall 24 of the shield 22, spaced about the circumference of the top wall 24. Each hole 38 is connected to one end of a conventional vacuum hose 40, and the other end of each hose 40 is connected to a conventional vacuum pump (not shown). The vacuum holes 38 are preferably spaced substantially equidistantly about the center of the top wall 24 between the abrasive wheel 12 and the skirt 26 and are adapted to provide pneumatic communication between the interior of the shield 22 and the vacuum pump through the vacuum hoses 40 so that dust, generated within the shield 22, can be removed by the vacuum pump.

As also shown in FIG. 2, the rear segment 30 of the top wall 24 of the shield 22 has a central hole 42 through which the shaft 14 can extend between the motor of the sander 10 and the abrasive wheel 12 to support and drive the wheel 12. Although the size of the central hole 42 is not critical, it is preferred that the central hole 42 be substantially smaller than the wheel 12 to minimize the amount of dust which can escape through the central hole from the shield 22. In this regard, it has been found that the plurality of vacuum holes 38, that are provided in the top wall 24 between the wheel 12 and the skirt 26 and that are connected to the hoses 40 and a vacuum pump (not shown), can remove virtually all of the dust generated by the operation of the abrasive wheel 12 within the shield 22 and will allow little or no dust to escape from the central hole 42 so long as the central hole 42 is substantially smaller than the wheel 12.

The method of mounting the shield 22 on the sander 10 also is not critical. It is preferred that the shield 22 be mounted so that it can pivot about the sander 10 in a direction perpendicular to the line 32 between the segments 28 and 30 of the top wall 24 (i.e., from front to rear). In this regard, a conventional circular clamp 44 is preferably mounted horizontally about the sander housing 16 with a pair of bosses 46 extending outwardly from opposite lateral sides of the clamp 44, and a pair of upstanding arms 48 are mounted on top of the rear segment 30 of the top wall 24 of the shield 22 on opposite lateral sides of the central hole 42. Each boss 46 extends through a hole in the upper portion of each arm 48. Stops 50 are preferably provided in front and in back of each boss 46 to limit the frontward and rearward pivoting movement of the arms 48 about the pair of bosses 46 and thereby limit the pivoting movement of the shield 22 about the sander 10.

It is thought that the invention and many of its attendant advantages will be understood from the foregoing description and that it will be apparent that various modifications and changes can be made in the invention without departing from the spirit and scope thereof or sacrificing all of its material advantages, the shield 22 hereinbefore described being merely a preferred embodiment. For example, the top wall 24 of the shield 22 need not be generally round, and the skirt 26 of the shield need not be generally cylindrical so long as the skirt 26 is completely outside (i.e., horizontally beyond) the horizontal level of the abrading part 12. Also, the shield 22 can be used with a non-rotary sander 10, such as a sander having an abrading part which moves horizontally, vertically or reciprocally relative to the housing 16 of the sander 10, so long as the shield's skirt 26 substantially surrounds horizontally any horizontal travel of the abrading part 12. Furthermore, terms such as "top", "bottom", "horizontal", "upwardly", "downwardly", "front" and "rear" are used herein as relative terms to describe the shield in FIGS. 1–3 and in the claims which follow.

I claim:

1. A vacuum shield for an abrading part of an abrading machine, comprising:

a generally planar top wall mounted on the abrading machine; the top wall of the shield being made of a rigid transparent material and comprising at least a first segment and a second segment; the first segment having a first hole therein, through which the abrading part can be supported and driven by the abrading machine; the first segment also having a plurality of second holes therein, each second hole being connected to a vacuum hose on top of the top wall and providing pneumatic communication through the top wall between the hose and the abrading part; and the second segment being pivotally connected to the first segment for upward pivotal movement of the second segment about its connection to the first segment; and a flexible skirt depending from the peripheral edge of the top wall and extending substantially continuously along the entire length of the peripheral edge of the top wall; the skirt being a continuous elastomeric member substantially surrounding horizontally the abrading part of the abrading machine, even when the second segment is pivoted upwardly relative to the first segment.

2. The shield of claim 1, wherein the top wall has a generally circular configuration and the skirt is generally cylindrical.

3. The shield of claim 1, wherein the bottom of the skirt is substantially parallel to the bottom of the abrading part of the abrading machine.

4. The shield of claim 3, wherein the bottom of the skirt is not spaced a substantial distance above the bottom of the abrading part.

5. The shield of claim 1, wherein the skirt is a continuous elastomeric member formed by a soft rubber blade or a thin rubber tubing.

6. The shield of claim 1, wherein the first and second segments of the top wall are connected along a line substantially parallel to the front of the shield.

7. The shield of claim 6, wherein the segments of the top wall are connected by a hinge provided with a stop which limits the upward pivoting movement of the second segment about the front of the first segment.

8. The shield of claim 7, wherein a spring is connected to the segments of the top wall for urging the second segment to pivot downwardly about the front of the first segment.

9. The shield of claim 1, which further includes means for connecting the top wall to the abrading machine so that the top wall can pivot about the abrading machine in a direction perpendicular to the pivotal connection of the segments of the top wall.

* * * * *